US005636440A

United States Patent [19]

Bichon et al.

[11] Patent Number: 5,636,440

[45] Date of Patent: Jun. 10, 1997

[54] PROCESS FOR MANUFACTURING A HOLLOW BLADE FOR A TURBO-MACHINE

[75] Inventors: Matthieu Bichon, Ermont; Charles J. P. Douguet, Vulaines sur Seine; Alain G. H. Lorieux, Sannois; Yvon M. J. Louesdon, Taverny; Florence A. N. Renou, Paris, all of France

[73] Assignee: Societe Nationale d'Etude et de Construction de Moteurs d'Aviation "Snecma", Paris, France

[21] Appl. No.: 521,583

[22] Filed: Aug. 30, 1995

[30] Foreign Application Priority Data

Sep. 7, 1994 [FR] France ..... 94 10690

[51] Int. Cl.[6] ..... B23P 15/00

[52] U.S. Cl. ..... 29/889.72; 29/889.7

[58] Field of Search ..... 29/889, 889.7, 29/889.72, 463; 228/157, 193, 234

[56] References Cited

U.S. PATENT DOCUMENTS

| | | | |
|---|---|---|---|
| 5,063,662 | 11/1991 | Porter et al. | 29/889.72 |
| 5,083,371 | 1/1992 | Leibfried et al. | 29/889.72 |
| 5,099,573 | 3/1992 | Krauss et al. | 29/889.7 |

*Primary Examiner*—Irene Cuda
*Attorney, Agent, or Firm*—Oblon, Spivak, McClelland, Maier & Neustadt, P.C.

[57] ABSTRACT

A process for manufacturing a hollow turbo-machine blade comprises the steps of:

(a) using computer aided design and manufacture (CAD/CAM) means to create, from a definition of the blade to be produced, a digital simulation of the flat form of the primary parts of said blade;

(b) die-forging said primary parts in a press observing certain conditions;

(c) machining said primary parts;

(d) depositing diffusion barriers on at least one of said primary parts according to a predefined pattern;

(e) assembling said primary parts, followed by diffusion welding them together under isostatic pressure;

(f) inflating the welded assembly and shaping it by superplastic forming; and, (g) final machining;
the process possibly also including an additional step of cambering and twisting the primary parts either before or after they are welded together.

15 Claims, 8 Drawing Sheets

3
4

5
6

VI
5
8

VI
8
9

PROCESS FOR MANUFACTURING A HOLLOW BLADE FOR A TURBO-MACHINE

BACKGROUND OF THE INVENTION

1. Field of the Invention

The present invention relates to a process for manufacturing a hollow blade for a turbo-machine.

The advantages stemming from the use of large chord blades for turbo-machines have become apparent, particularly in the case of the fan rotor blades of bypass turbojet engines. These blades must meet severe conditions of use and, in particular, must possess satisfactory mechanical characteristics associated with anti-vibration properties and the ability to withstand impact from foreign bodies. Furthermore, in order to achieve sufficient speeds at the tips of the blades they are generally made hollow so as to keep the mass as low as possible.

2. Summary of the Prior Art

EP-A-0 500 458 describes a process for the manufacture of a hollow blade for a turbo-machine, particularly a large chord blade for a fan rotor. The primary blade parts utilized in this process comprise two outer metal sheets and at least one central metal sheet. The process described includes a hot-forming operation with bending and twisting of the parts, a diffusion welding operation in specific areas, and an inflation operation using pressurised gas inducing a superplastic shaping bringing the outer surfaces of the blade to the desired profile. Suitable tools, particularly shaping dies, are used for carrying out these operations.

It is an object of the invention to improve this and the numerous other known processes for the manufacture of hollow blades, with a view to obtaining blades with improved mechanical characteristics optimized for the conditions of use, while ensuring repeatability of quality and ease of manufacture at low cost.

SUMMARY OF THE INVENTION

To this end, the invention provides a process for manufacturing a hollow blade for a turbo-machine from a plurality of primary parts, particularly a large chord fan rotor blade, including the following steps:

(a) using computer aided design and manufacture (CAD/CAM) means to create, from a definition of the blade to be produced, a digital simulation of the flat form of the primary parts of said blade;

(b) die-forging said primary parts in a press;

(c) machining said primary parts;

(d) depositing diffusion barriers on at least one of said primary parts according to a predefined pattern;

(e) assembling said primary parts and diffusion welding them together under isostatic pressure;

(f) inflating the welded assembly of said primary parts using pressurized gas and superplastically shaping said assembly; and (g) final machining of said shaped assembly;

wherein said die-forging operation in step (b) is carried out in a hot die at a temperature between 0.7 and 0.8 Tf where Tf is the melting temperature of the material being forged, and with the temperature of the tooling raised to substantially 80% of the temperature of the part;

wherein the blank of each part used has a specific trapezoidal shape so as to obtain a final product with a fineness equivalent to about 0.02 times the width of the blade and a working of the metal which guarantees a grain size sufficient to ensure good diffusion welding conditions in step (e) and the desired mechanical characteristics for the finished blade, including good fatigue resistance;

and wherein when the thickness of the said parts, associated with the deformation ratio, is less than the buckling limit, said process includes an additional step of cambering and twisting leading to an elongation of the fibres of the material of the part enabling the neutral fibre to be brought to its final length on both sides of the axis of the part.

When the blade is made of a titanium alloy of type TA6V, the use of a die-forging temperature for the parts of between 880° C. and 950° C., and a tooling temperature of between 600° C. and 850° C., enables parts to be obtained having a grain size of less than 10 μm.

Advantageously, the cambering and twisting operation is carried out after the diffusion welding step since it is much easier to apply the diffusion barriers in accordance with a predetermined pattern on a part when it is flat.

Producing a fan blade with very high compression ratio presupposes a very pronounced cambering of the vane base and an accentuated, non-continuous twisting. This requires a specific operation of fibre elongation preceding the twisting operation. In this case the fibre elongation step is preferably carried out after the diffusion welding step, and the twisting operation may be integrated with the inflation and superplastic shaping operation.

Alternatively, the cambering and twisting operation for the blades may be carried out after the die-forging operation in the case of test developments requiring a small series of parts, or after the step of machining the primary parts in the case of simple aerodynamic shapes.

Preferably, the cambering and twisting operation is carried out in a press, in an isothermal manner, and in the case of a titanium alloy of TA6V the temperature will be between 700° and 940° C.

This operation requires locking the ends of the part so as to ensure an effective elongation of the fibres in the selected areas, without any tearing. The length of the central fibre remains unchanged and the elongation ratio of the other fibres varies according to their distance from this central fibre.

Other preferred characteristics and advantages of the invention will become apparent from the following description of the preferred embodiments of the invention, given by way of example only, with reference to the attached drawings.

DESCRIPTION OF THE PREFERRED EMBODIMENTS

The first step (a) of the process for making a hollow blade for a turbo-machine fan in accordance with the invention comprises an operation termed "flattening", starting from the definition of the finished part. The "flattening" operation consists of simulating deflation and then untwisting and unbending of the finished blade. The principles of construction and checking of a fan blade are based on the utilization of definition sections distributed along the engine axis. Each section is worked so that the assembly of the other constituent parts of the blade such as 11, 12 are applied to the unchanged intrados skin 13. The thickness of the extrados skin 11 is adjusted depending upon its subsequent lengthening during the shaping operation. At this stage, a digital simulation of the inflation is performed, confirming the intermediate result.

Figure 1:
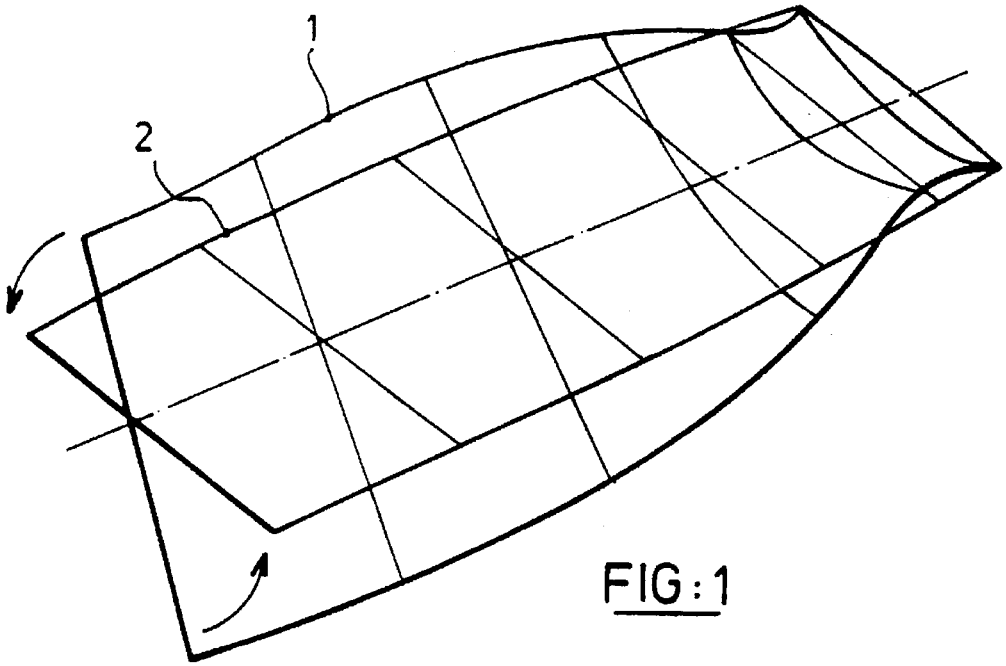
FIG. 1 shows a diagrammatic view of the simulation of the flat form of a hollow blade in the first step of the manufacturing process of the invention.

As shown in FIG. 1, the final twisted geometry is converted to a flat state. The untwisting and unbending is a delicate operation for which the process of the invention provides an automated method, respecting the preservation of the volume through the distribution of material as a function of the deformation ratio linked with the position of each section.

At this stage, a new digital simulation of the twisting is performed, confirming the final result.

Preferably, it is possible to carry out the flattening in a single operation, without the deflation step.

Figure 9:
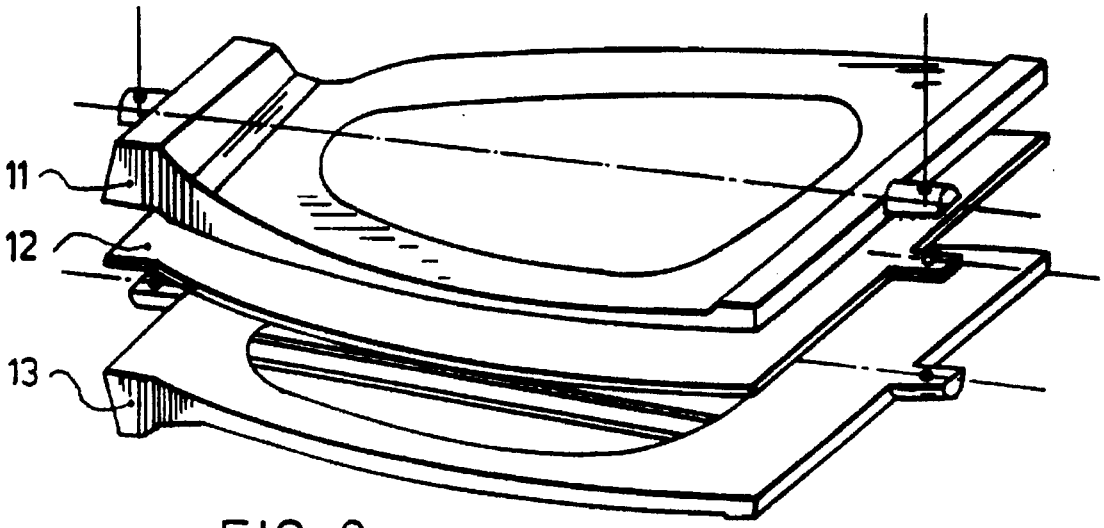
FIG. 9 shows a perspective view of the primary parts of a hollow blade at the assembly stage, prior to the step of diffusion welding the parts together.

The second step (b) of the process consists of die-forging, in a press, the primary parts constituting the blade, such as 11, 12, 13 as may be seen in FIG. 9. In the previously known techniques, these parts are made from rolled metal sheets, as it was considered that dimensions and size do not allow a sufficiently precise and fine blank to be obtained by forging.

Figures 2, 3, 4, 5, 6:
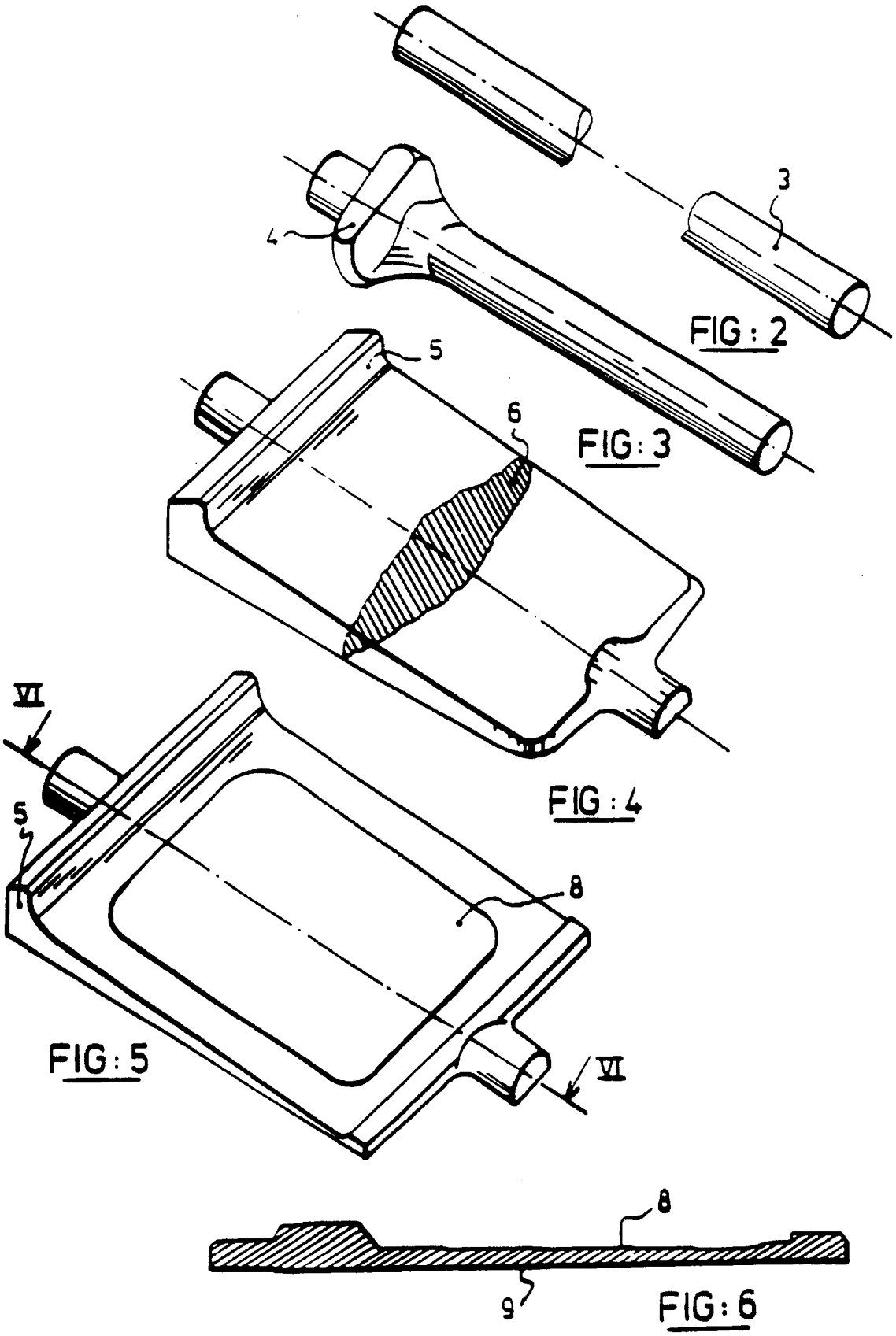
FIG. 2 shows a perspective view of a starting blank in one embodiment of the process of the invention.
FIG. 3 shows the part of FIG. 2 at a first stage of its shaping.
FIG. 4 shows the part of FIGS. 2 and 3 at a subsequent stage of its shaping.
FIG. 5 shows a perspective view of the part obtained at the end of the forging and machining steps of the process.
FIG. 6 shows a cross-section in a plane passing through the longitudinal axis of the part shown in FIG. 5, along line VI—VI of FIG. 5.

In accordance with the invention, and as is known per se in precision forging, the initial blank consists of a bar 3 (see FIG. 2) made of a titanium alloy, such as TA6V, of sufficient dimensions (diameter between 80 and 120 mm) to produce a blank of the desired primary part. As shown in FIG. 3, one or more upsetting operations achieve the positioning of the material in the large volume areas of the vane root 4 or end.

At this stage, the bars are heated to a temperature between 880° C. and 950° C., while the tooling is heated to a temperature between 200° and 250° C.

One of the difficulties which the process of the invention deals with is the ability to produce forged blanks 5 such as shown in FIG. 5, with dimensions, and especially thickness, which enable economic production of large chord blades. The inventors have perfected a method of forging blanks which makes it possible to guarantee the production of accurately gauged blanks with a high power press.

Making large chord fan blades for a turbojet engine requires large-size blanks. As an example, a turbojet engine of the 270 KN thrust class requires blades of about 500 mm width. This width is further increased by possible over-widths which may reach about 50 mm at each edge in order to facilitate functions such as assembly and holding of the product during manufacture.

Figure 7:
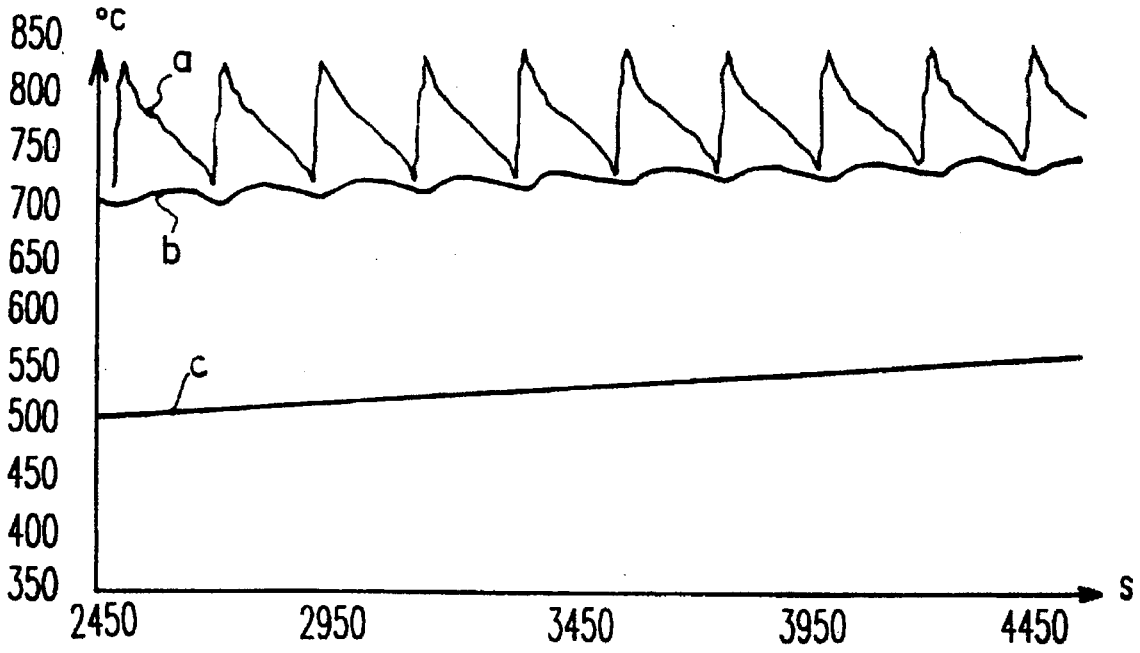
FIG. 7 is a diagram reproducing a cycle of the changes in the temperature of the part during the die-forging of the part.

In order to obtain a sufficiently fine product and also to restrict raw materials and machining costs, while limiting forging pressure, the inventors have perfected a process including a judicious combination of a trapezoidal shape 6 of the blank 5 such as shown in FIG. 4, and the lubrication and heating of the tooling. In particular, the press forging or die-forging operation which enables the parts such as 5 in FIG. 4 to be obtained is carried out by heating the part to a temperature between 880° C. and 950° C., and the tooling to a temperature between 700° C. and 900° C. It is then possible to make a product with a fineness ratio, defined by the thickness to width ratio of the blade, of the order of 0.02. FIG. 7 shows a diagram of the temperature development in each forging. Curve a corresponds to the temperature of the die contact surfaces, curve b the internal temperature of the tooling, and curve c the temperature of the tool holder. It will be seen that as a result of a perfectly controlled die-forging cycle, the temperature cycle varies between 720° C. and 840° C.

The structure of the initial bars 3 is rough when compared with the standard specifications applying to bars of smaller sizes (diameter 50 mm) used for the die-forging of standard turbojet blades. However, the forging and die-forging enable the structure to be refined significantly, as the grain size is decreased from 10 μm on an average to 7 μm. This operation thus allows a gain of an average of 30 MPa on the fatigue resistance of the final product, despite the thermal cycles of diffusion welding and of inflation which follow the forging operation.

In the example shown in FIGS. 5 and 6, the precision of the forging provides a forge-finished outer left surface 8, and the final surface condition is achieved by selective numerically controlled polishing, carried out on a 5-axis polishing machine.

The finishing of the inner surface 9 of the primary part is carried out by machining, using any suitable known machining process, and these machining operations constitute step (c) of the process of the invention.

Figure 8:
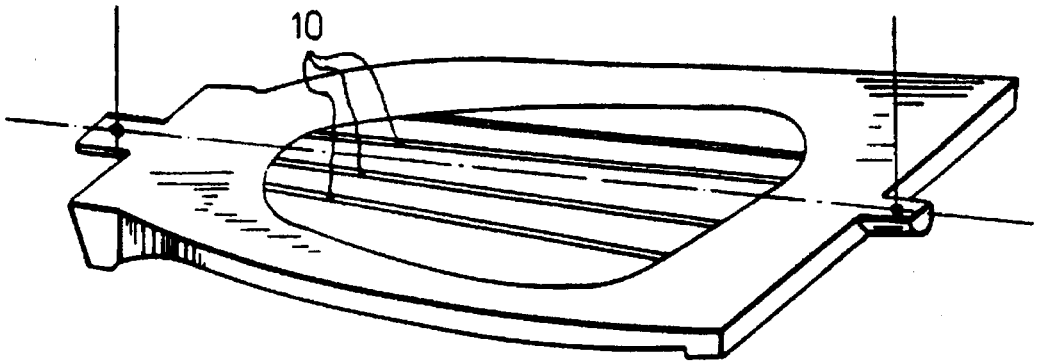
FIG. 8 shows a perspective view of a primary constituent part of a hollow blade in one embodiment of the process of the invention, after the step of depositing anti-diffusion barriers.
Figure 10:
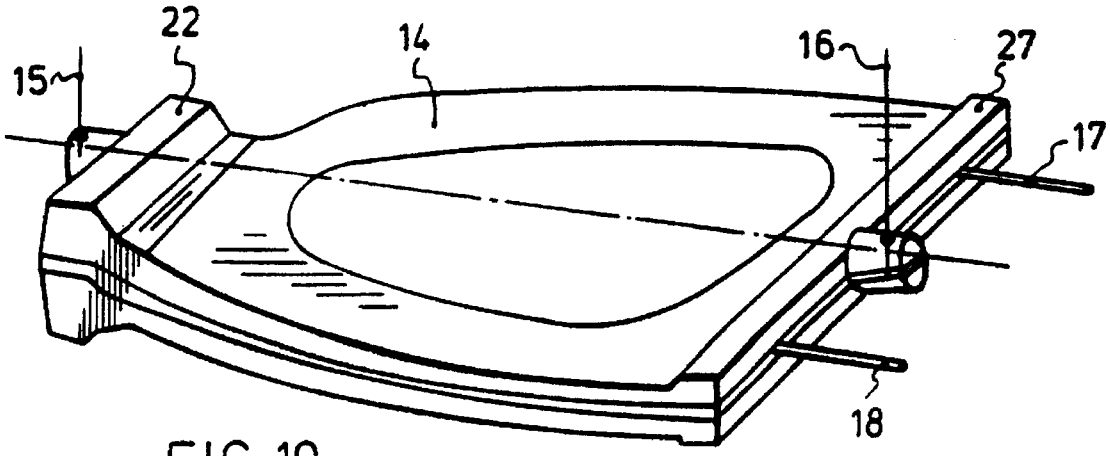
FIG. 10 shows a perspective view of the parts of FIG. 9 after they have been diffusion welded together.

The operations in steps (d) and (e) of the process make use of already known techniques comprising, in step (d):

thorough cleaning of the surfaces, particularly the inner surfaces, of the primary parts;

application of an anti-diffusion product on at least two of the inner faces in a predefined pattern 10, such as by a standard silk screen printing process as shown diagrammatically in FIG. 8;

baking the anti-diffusion product at between 250° C. and 280° C. to degrade all or part of the binder;

followed in step (e) by:

assembling the primary parts 11, 12, 13 so as to obtain a sandwich 14 using at least two centring studs 15 and 16 as shown in FIGS. 9 and 10;

TIG or electron beam welding of the periphery of the assembly and then, possibly, of two evacuation tubes 17, 18;

exhausting to vacuum in a vacuum enclosure and closing the tubes 17, 18, should they be used; and, diffusion welding at a temperature of 875° C. to 940° C., and at a pressure of 30 to $40\times10^5$ Pa for a minimum of 1 hour.

The following steps (f) of pressurized inflation and superplastic forming of the welded assembly, and (g) of final machining of the blade, are then carried out under known conditions, the parameters, particularly the temperature and the pressures applied, being determined depending on the material of the parts.

However, depending on the particularly applications of the process of the invention to the production of fan blades, a shaping of the parts by cambering/twisting may also be necessary. In this case, the cambering/twisting is a difficult operation which requires a certain number of precautions to prevent the development of corrugations due to the elongation of different portions of the part during this operation.

Figure 11:
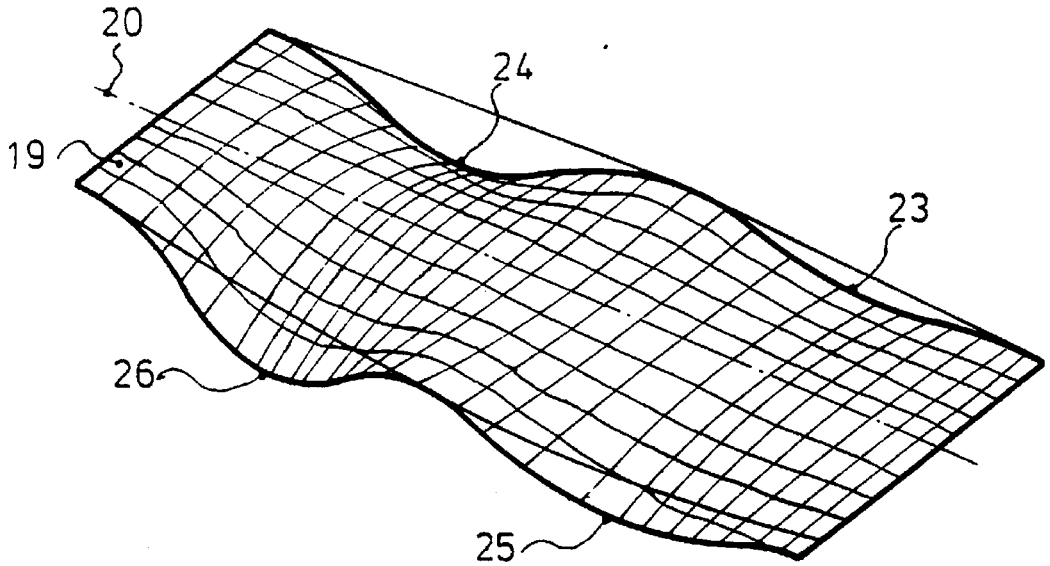
FIG. 11 shows diagrammatically the result of a digital simulation of an operation to set the length of the fibres to be performed on the assembled constituent parts of the hollow blade in an embodiment of the process of the invention.
Figure 12:
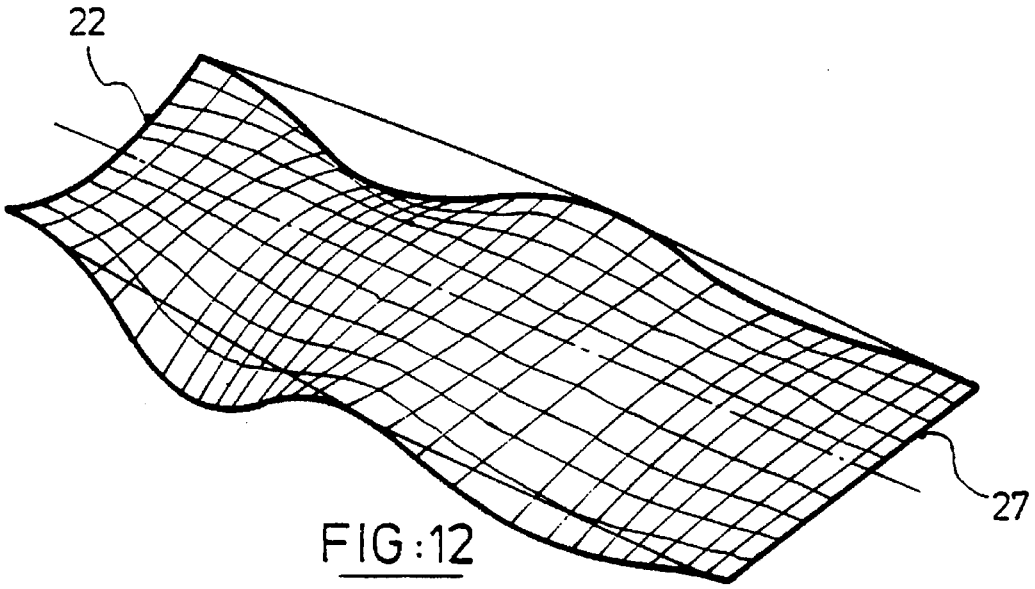
FIG. 12 is a view similar to FIG. 11 showing the result of a digital simulation of a further operation to be performed on the assembled blade parts.

First of all, a geometrical operation is performed on a CAD/CAM system so as to keep the lengths of the fibres on both sides of the neutral fibre dependent on their position relative to the axis 20 of the part 19, as shown in FIGS. 11 and 12. At this stage a digital simulation of the twisting is carried out to confirm the final result.

Figure 13:
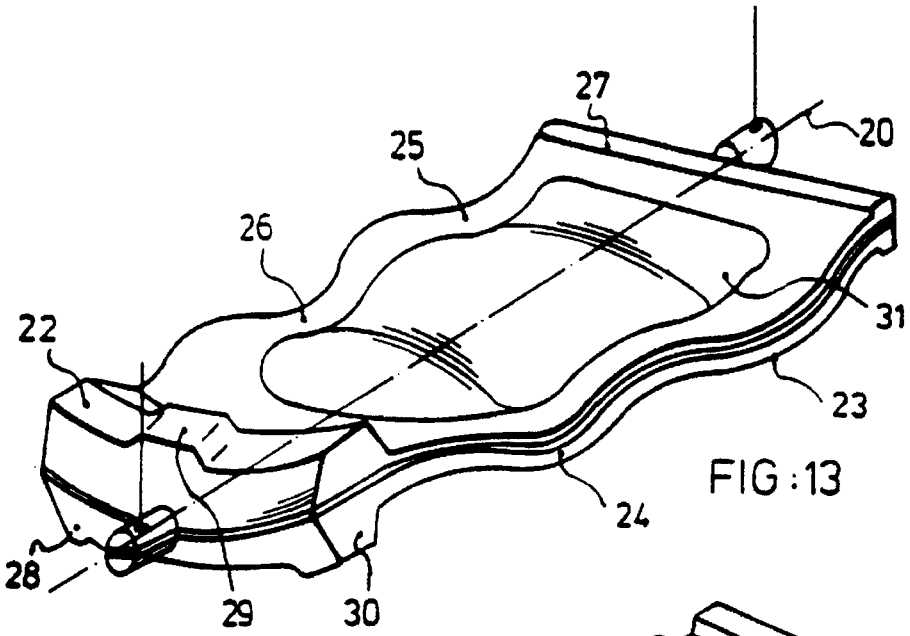
FIG. 13 shows a perspective view of the assembled blade parts after a shaping operating resulting in elongation of the fibres.
Figure 14:
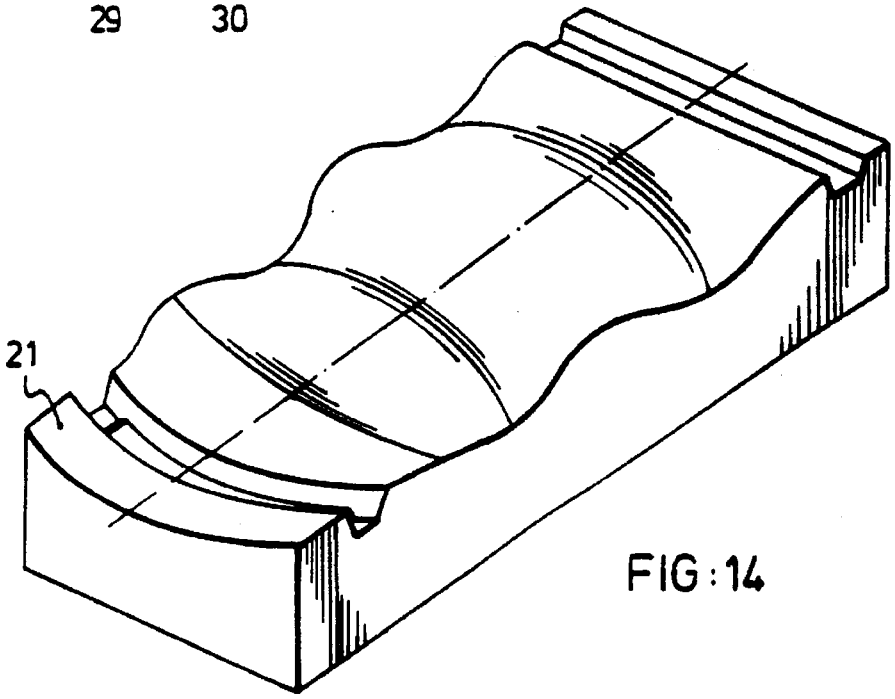
FIG. 14 shows a diagrammatic perspective view of an example of a press tool used to obtain the shaped assembly of FIG. 13.

The actual operation of achieving the elongation of the various fibres of the part 19 is performed by isothermally deforming the primary part or the welded assembly in a press at a temperature between 700° and 940° C. using a tool 21. The operation is performed under a controlled pressure between two metal or ceramic tools at the same temperature as the part, i.e. 700° C. to 940° C. The geometric profile of the tool 21, obtained by CAD/CAM, integrates the shape of the solid part of the root 22, and, laterally, the changing elongation of the fibres in one or more waves 23, 24, 25, 26, the amplitude of which varies with the required elongation ratio, as diagrammatically shown in FIGS. 13 and 14. The elongations will generate longitudinal compression stresses generally situated on the axis 20 of the part, and these stresses will be contained by an immbilization at each end, i.e. at the root 22 and tip 27, of the blade.

Figure 15:
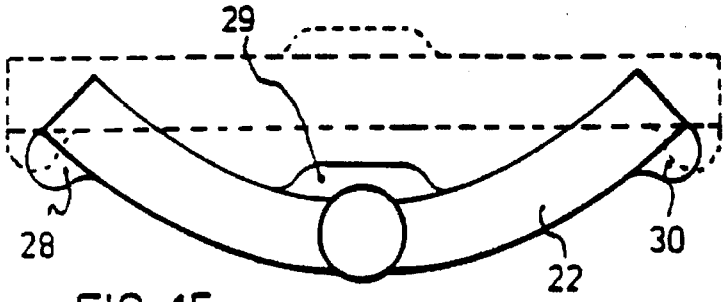
FIG. 15 shows a view from the end of the blade assembly of FIG. 13 showing the result of a cambering operation for the foot of the blade.

This operation may include the cambering of the root 22. The provision of judiciously sited over-thicknesses 28, 29, 30 as shown in FIG. 15 ensures a hold from the first contact between part and tool.

Figure 16:
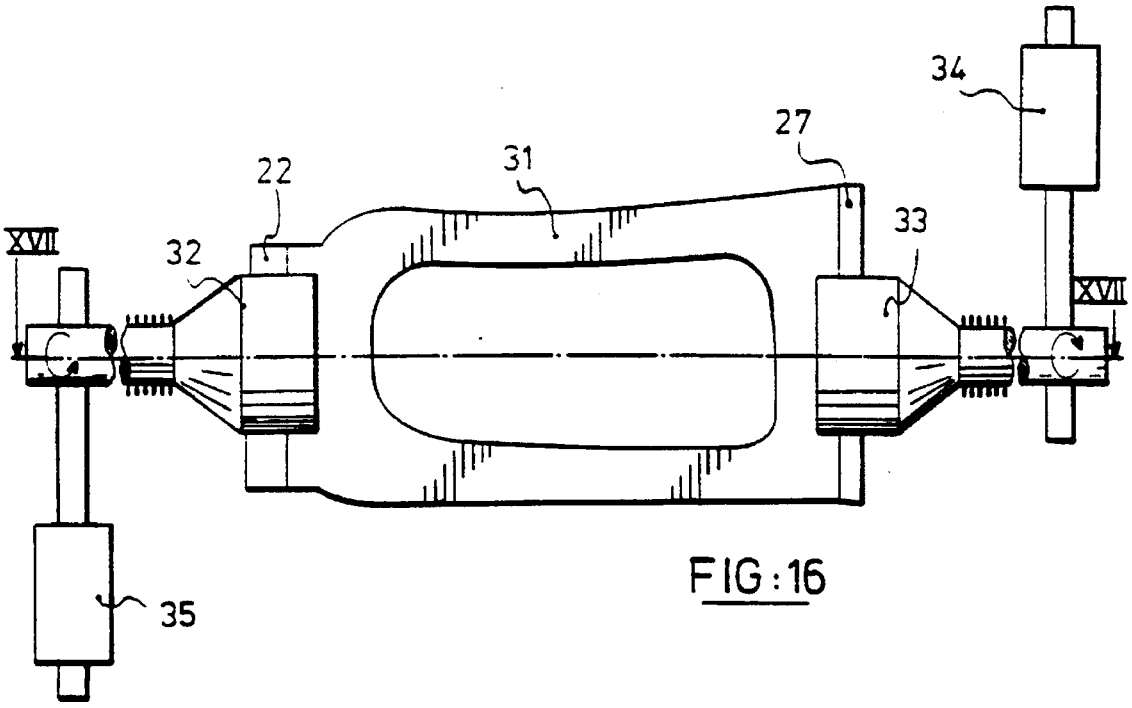
FIG. 16 shows a diagrammatic view of the twisting operation carried out on the blade assembly of FIGS. 13 and 15.
Figure 17:
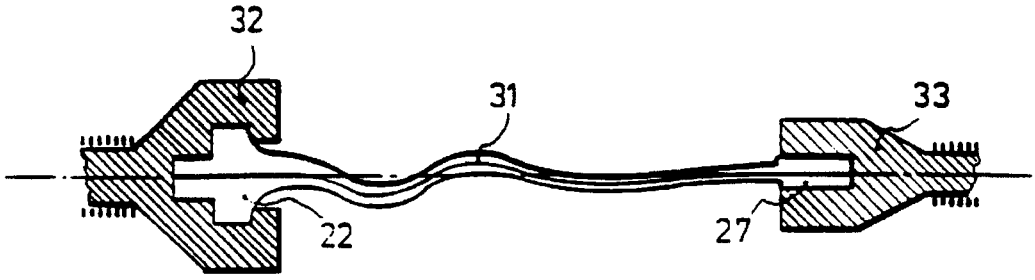
FIG. 17 is a sectional view in a plane passing through the longitudinal axis of the assembly and taken along line XVII—XVII of FIG. 16.
Figure 18:
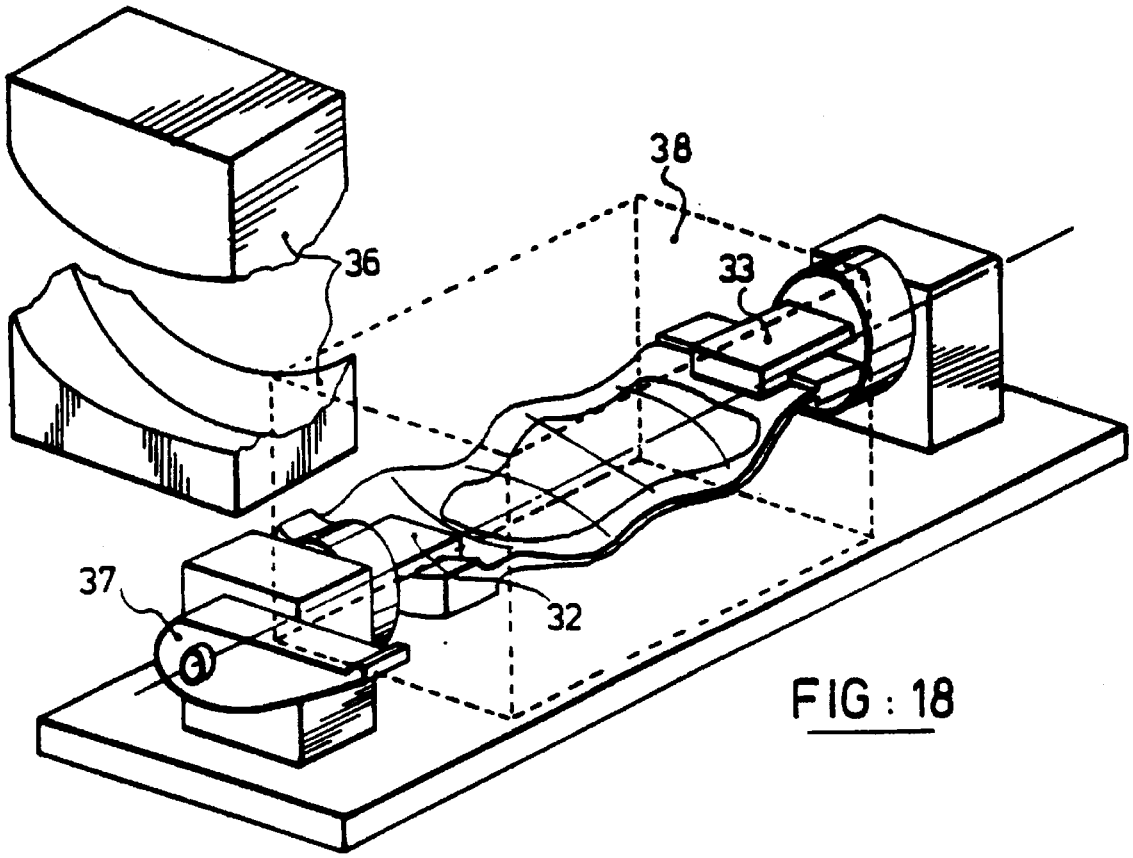
FIG. 18 shows a diagrammatic perspective view of an alternative arrangement for carrying out the twisting of the blade assembly of FIGS. 13 and 15.

For the twisting operation, the welded assembly 31 is held at each end by two clamping jaws 32, 33 as diagrammatically shown in FIGS. 16 and 17, at least one of the jaws being rotatable. The twisting operation is carried out in a furnace or a heating enclosure, at a plastic flow temperature between 880° C. and 920° C. depending on the alloy of the welded assembly. Fly-weights 34, 35 impose upon the part a perfectly controlled twisting limited by stops (not shown).

Alternatively, in another method the rotating motion of at least one of the clamping jaws may be supplied by means of a mechanical system acting on a lever arm 37, which is then performed by two fingers fixed on the movable part of a press, to which there is added a local heating enclosure 38. Locally added stamps 36 can be provided to obtain an enhanced streamlined shape for the trailing edge.

In both cases, one of the jaws may be fitted with a helical coupling so as to apply a tensile stress to the part during twisting in order to prevent the development of the corrugation phenomenon.

It is also possible to effect the rotating motion of at least one of the jaws by an electric or hydraulic motor, thermally protected in the working area.

Figure 19:
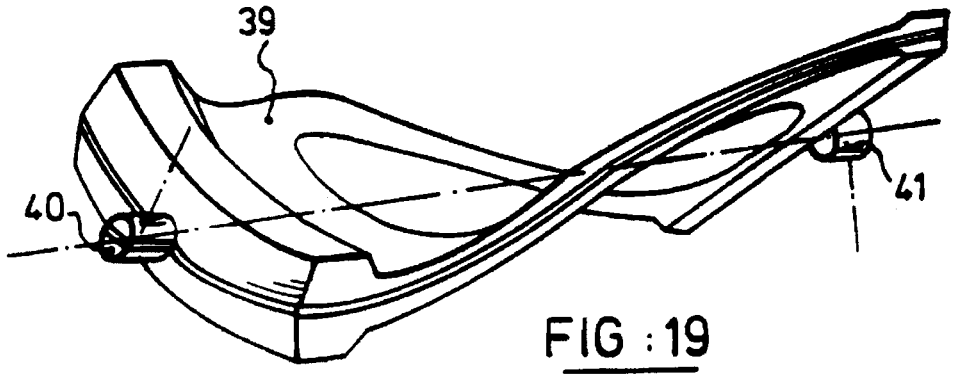
FIG. 19 shows a perspective view of the blade assembly obtained after the twisting operation.
Figure 20:
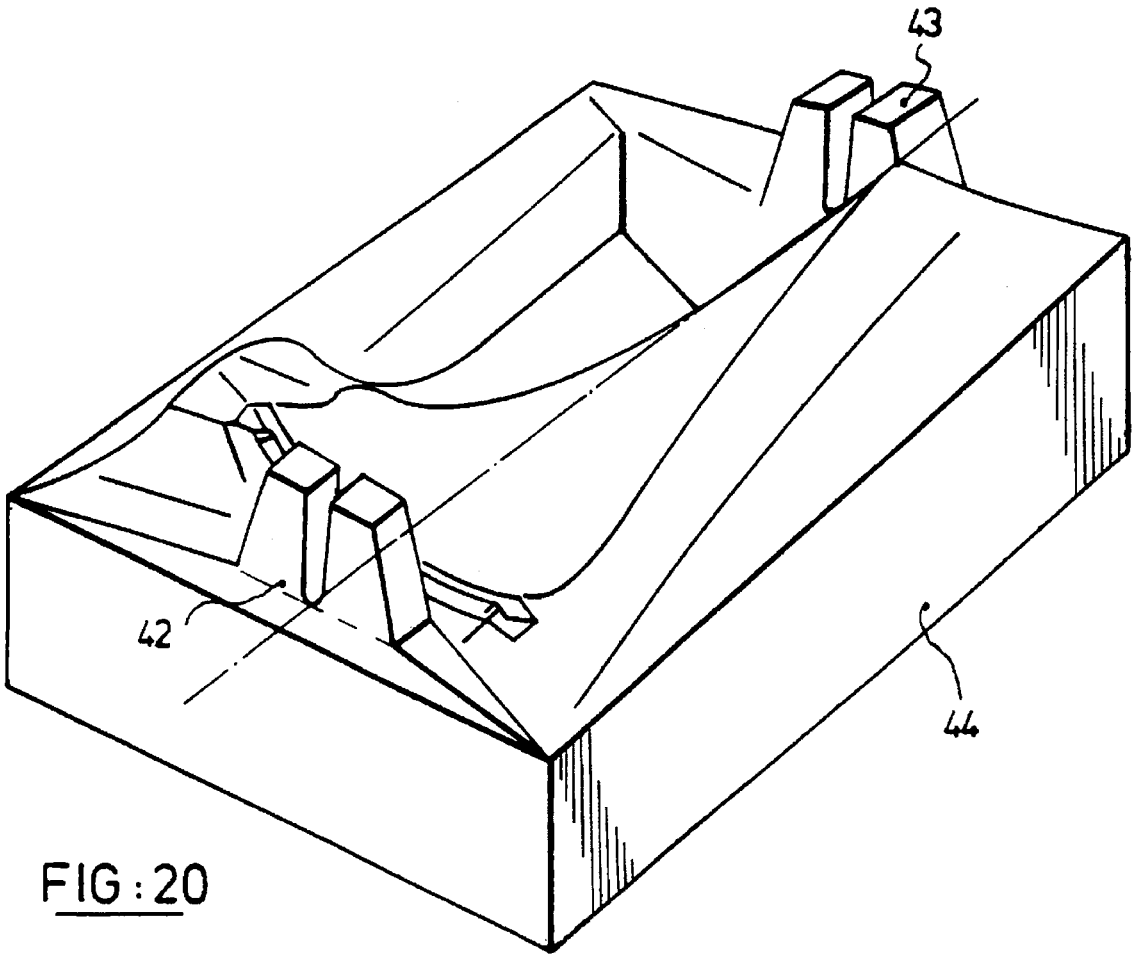
FIG. 20 shows a diagrammatic perspective view of one example of part of the equipment used during the step of superplastic shaping of the blade assembly of FIG. 19; and, FIG. 21 shows a diagrammatic transverse sectional view through one example of the blade assembly profile before the inflation step and, in dashed lines, after the inflation.
Figure 21:
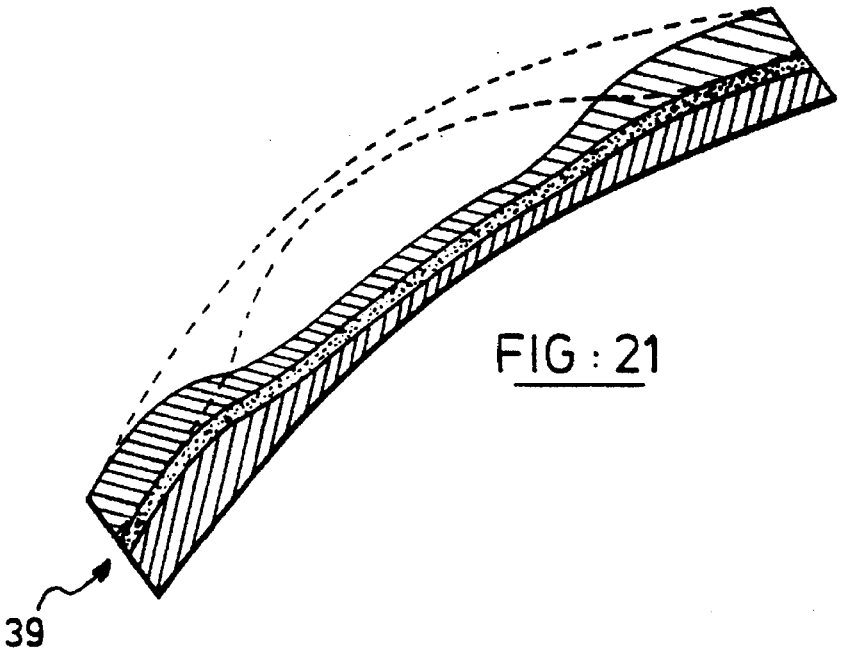

The twisted blade 39 thus obtained is shown in FIG. 19 and is held by its support pins 40, 41 during the closing of the superplastic forming mould 44, these pins being received vertically by notches 42, 43 as shown in FIG. 20.

The superplastic forming operation is carried out at between 850° and 940° C. at a pressure of 20 to $40\times10^5$ Pa of argon.

Advantageously, starting from the geometry obtained after elongation of the fibres, the blade 39 may be formed in the same operation as the inflation. The resulting reduction in the number of heatings helps the preservation of the improved mechanical characteristics obtaining by forging the constituent parts of the blade.

We claim:

1. A process for manufacturing a hollow blade for a turbo-machine from a plurality of primary parts, particularly a large chord fan rotor blade, including the following steps:

(a) using computer aided design and manufacture (CAD/CAM) means to create, from a definition of the blade to be produced, a digital simulation of the flat form of the primary parts of said blade;

(b) die-forging said primary parts in a press;

(c) machining said primary parts;

(d) depositing diffusion barriers on at least one of said primary parts according to a predefined pattern;

(e) assembling said primary parts and diffusion welding them together under isostatic pressure;

(f) inflating the welded assembly of said primary parts using pressurized gas and superplastically shaping said assembly; and (g) final machining of said shaped assembly;

wherein said die-forging operation in step (b) is carried out in a hot die at a temperature between 0.7 and 0.8 Tf where Tf is the melting temperature of the material being forged, with the temperature of the tooling raised to substantially 80% of the temperature of the part;

wherein the blank of each part used has a specific trapezoidal shape so as to obtain a final product with a fineness equivalent to about 0.02 times the width of the blade and a working of the metal which guarantees a grain size sufficient to ensure good diffusion welding conditions in step (e) and the desired mechanical characteristics for the finished blade, including good fatigue resistance;

and wherein when the thickness of the said parts, associated with the deformation ratio, is less than the buckling limit, said process includes an additional step of cambering and twisting leading to an elongation of the fibres of the material of the part enabling the neutral fibre to be brought to its final length on both sides of the axis of the part.

2. A process according to claim 1, wherein step (a) includes creating a digital simulation of a deflated blade wherein the primary part on the intrados side of the blade is unchanged and the other primary parts are applied against said unchanged part.

3. A process according to claim 2, wherein said digital simulation of said deflated blade is followed by digitally simulating untwisting and unbending so as to obtain a flat product.

4. A process according to claim 1, wherein step (a) includes digitally simulating complete flattening of the blade in a single operation, starting from the final twisted geometry of the blade.

5. A process according to claim 1, wherein said blade is made of a titanium alloy of type TA6V, and the die-forging temperature of said parts is between 880° C. and 950° C., the temperature of said tooling is between 600° C. and 850° C., and the die-forging operation permits parts to be obtained having a metallurgical microstructure with a grain size less than 10 μm.

6. A process according to claim 1, wherein said additional cambering and twisting step is carried out after said diffusion welding step (e).

7. A process according to claim 1, wherein a fibre stretching step is carried out after said diffusion welding step (e), and a twisting operation is integrated with the inflation and superplastic shaping operations in step (f).

8. A process according to claim 1, wherein said additional cambering and twisting step is carried out after said die-forging step (b).

9. A process for manufacturing a hollow rotor fan blade for a turbo-machine from a plurality of primary parts, including the following steps:

(a) using computer aided design and manufacture (CAD/CAM) means to create, from a definition of a blade to be produced, a digital simulation of a flat form of primary parts of said blade;

(b) die-forging said primary parts in a press;

(c) machining said primary parts;

(d) depositing diffusion barriers on at least one of said primary parts according to a predefined pattern;

(e) assembling said primary parts and diffusion welding the assembled primary parts together under isostatic pressure to form a welded assembly;

(f) inflating the welded assembly of said primary parts using pressurized gas and superplastically shaping said assembly to form a shaped assembly; and (g) final machining of said shaped assembly;

wherein said die-forging operation in step (b) is carried out in a hot die at a temperature between 0.7 and 0.8 Tf where Tf is the melting temperature of the material being forged, and with the temperature of the tooling raised to substantially 80% of the temperature of the primary part being forged;

wherein a blank of each primary part used has a specific trapezoidal shape so as to obtain a final product with a fineness equivalent to about 0.02 times the width of the blade and a working of the metal of the blank which guarantees a grain size sufficient to ensure good diffusion welding conditions in step (e) and desired mechanical characteristics for the finished blade, including good fatigue resistance;

and wherein when the thickness of the said primary parts, associated with the deformation ratio, is less than a buckling limit thereof, said process includes an additional step of cambering and twisting leading to an elongation of fibres of the material of the primary part enabling the neutral fibre to be brought to a final length thereof on both sides of an axis of the primary part.

10. A process according to claim 1, wherein said cambering and twisting operation is carried out isothermally in a press.

11. A process according to claim 10, wherein said blade is made of titanium alloy of type TA6V, and the isothermal forging temperature during said cambering and twisting operation is between 700° C. and 940° C.

12. A process according to claim 10, wherein at least the two ends of the part are located during said cambering and twisting operation so as to ensure an effective lengthening of the fibres in the selected areas, the elongation ratio of the fibres varying according to their distance from an axial fibre of the part whose length remain unchanged.

13. A process according to claim 12, wherein local tooling stamps reposition the previously lengthened fibres during said twisting operation so as to obtain an accentuated aerodynamic shape in a selected area.

14. A process according to claim 12, wherein at least one end of the part is locked during said twisting operation by means which includes a device making it possible to exert on said part a rotation and a traction along the axis of the part.

15. A process according to claim 1, wherein an additional step of press forming said primary parts is carried out after step (b).

* * * * *